US008376681B2

(12) United States Patent
Thillen et al.

(10) Patent No.: US 8,376,681 B2
(45) Date of Patent: Feb. 19, 2013

(54) CHARGING DEVICE FOR A SHAFT FURNACE

(75) Inventors: Guy Thillen, Diekirch (LU); Jeannot Loutsch, Mondercange (LU); Guy Wagner, Hovelange (LU)

(73) Assignee: Paul Wurth S.A., Luxembourg (LU)

( * ) Notice: Subject to any disclaimer, the term of this patent is extended or adjusted under 35 U.S.C. 154(b) by 713 days.

(21) Appl. No.: 12/088,790

(22) PCT Filed: Aug. 8, 2006

(86) PCT No.: PCT/EP2006/065131

§ 371 (c)(1),
(2), (4) Date: Mar. 31, 2008

(87) PCT Pub. No.: WO2007/039339

PCT Pub. Date: Apr. 12, 2007

(65) Prior Publication Data

US 2008/0232940 A1 Sep. 25, 2008

(30) Foreign Application Priority Data

Sep. 30, 2005 (EP) ..... 05109118

(51) Int. Cl.
*B66C 17/08* (2006.01)

(52) U.S. Cl. ..... 414/193; 414/301; 414/195

(58) Field of Classification Search ..... 414/301, 414/195, 193

See application file for complete search history.

(56) References Cited

U.S. PATENT DOCUMENTS

| | | | | |
|---|---|---|---|---|
| 3,780,887 | A * | 12/1973 | Bottoms | 414/299 |
| 4,029,220 | A | 6/1977 | Greaves et al. | |
| 4,767,322 | A | 8/1988 | Beckenbach et al. | |
| 5,372,467 | A * | 12/1994 | Harris | 414/301 |
| 7,311,486 | B2 * | 12/2007 | Gorza et al. | 414/301 |

FOREIGN PATENT DOCUMENTS

| | | |
|---|---|---|
| JP | 04358015 | 12/1992 |
| SU | 739320 | 6/1980 |
| SU | 870435 | 10/1981 |
| SU | 930947 | 8/1990 |

OTHER PUBLICATIONS

International Search Report PCT/EP2006/065131 Dated Nov. 23, 2006.

* cited by examiner

*Primary Examiner* — Saul Rodriguez
*Assistant Examiner* — Willie Berry, Jr.
(74) *Attorney, Agent, or Firm* — Cantor Colburn LLP

(57) ABSTRACT

A charging device for charging a shaft furnace, including a rotary distributor and a variable drive for rotating the rotary distributor about an essentially vertical axis of rotation, where the rotary distributor includes a plurality of guiding members which form sliding channels for charge material, and where the rotary distributor comprises a junction slide from which each guiding member issues and which is arranged such that a flow of charge material slides via one specific guiding member in function of the velocity and/or the sense of rotation of the rotary distributor.

19 Claims, 3 Drawing Sheets

CHARGING DEVICE FOR A SHAFT FURNACE

TECHNICAL FIELD OF THE INVENTION

The present invention relates to a charging device for charging a shaft furnace and in particular for a blast furnace.

BRIEF DISCUSSION OF RELATED ART

During the last decades a charging system developed by the applicant has found widespread use throughout the world for charging and distributing bulk material onto a charging surface inside the blast furnace. This system, known by the name "bell-less top" (BLT), comprises a rotary chute with variable angle of inclination and corresponding drive equipment. BLTs with such rotary-pivoting chutes have been disclosed for example in WO 95/21272, U.S. Pat. Nos. 5,022,806, 4,941,792, 3,814,403 and 3,693,812 by the applicant. The chute is suspended in cantilever manner from a rotor having a substantially vertical axis of rotation and can be pivoted on this rotor about a substantially horizontal suspension axis to change the inclination. By rotation about this vertical axis and by varying the inclination of the chute by means of a pivoting mechanism, it is possible to direct the bulk material to virtually any point on the charging surface. Accordingly, besides many other advantages, the BLT enables a wide variety of charging profiles due to its versatility in distributing the burden on the charging surface. This requires however highly developed mechanical equipment, in particular regarding the mechanism required for varying the angle of inclination of the chute during charging.

Hence, there is a desire for a simpler and consequently less expensive solution, particularly for small and medium sized furnaces. Obviously, such a simpler solution should not lack the desirable versatility in burden distribution.

A solution which addresses this desire to some extent is described in U.S. Pat. No. 5,695,085 which discloses an apparatus for charging a shaft furnace. This apparatus represents an improvement of a device known by the name "Rotary Charging Unit" and disclosed e.g. in WO 92/019776. This apparatus comprises a unit for distributing the burden over a cross section of a shaft furnace which is mounted in a throat zone beneath the outlet of a bin for storing the burden. The distributing unit is adapted to rotate about the furnace axis on a shaft driven by a variable drive and comprises at least two guiding members circumferentially disposed around the periphery of a horizontal member. Each guiding member consist of two segments sequentially arranged in the direction of flow of burden.

Due to the design of the distributing unit, in particular due the rotationally symmetrical arrangement of the guiding members, a flow of burden received from the bin outlet is divided into at least two simultaneous partial flows in order to obtain charge layers with approximately even circumferential grain-size distribution. Due to the arrangement of the second segments of the guiding members and the rotation of the distributing unit about the furnace axis, various different charging profiles can be achieved.

A drawback of the latter apparatus lies in the fact that concentric and rotationally symmetrical feeding of bulk material onto the distributing unit is a necessary requirement in order to achieve best possible uniformity of the circumferential distribution of the burden. In fact, if the flow of bulk material is only slightly eccentric or asymmetrical, more bulk material will be charged to one portion of the charging surface whereas less bulk material will be charged to the remainder of the charging surface. Another drawback of this apparatus is the complex construction of the distributing unit itself which is therefore relatively expensive and complicating maintenance. Furthermore, it is believed that this device can achieve only a relatively coarse precision in creating charging profiles due to its spreader type distribution of bulk material.

BRIEF SUMMARY OF THE INVENTION

The invention provides a charging device for charging a shaft furnace of simple construction which brings about improvement in view the aforementioned problems.

More specifically, the present invention proposes a charging device for charging a shaft furnace, comprising a rotary distributor and a variable drive for rotating the rotary distributor about an essentially vertical axis of rotation, which generally coincides with the central axis of the shaft furnace. The rotary distributor comprises a plurality of guiding members, which form sliding channels for charge material (burden). According to an important aspect of the invention, the rotary distributor comprises a junction slide from which each guiding member issues and which is arranged such that a flow of charge material slides via one specific guiding member in function of the velocity and/or the sense of rotation of said rotary distributor.

The different guiding members respectively allow to select a corresponding annular ring area on the charging surface, onto which charge material is to be directed. It will be appreciated that this selection is done by adjusting only the rotating velocity. By maintaining a single coherent flow of charge material on the rotary distributor, this relatively simple construction allows to achieve a wide variety of charging profiles and a high circumferential uniformity of the distribution. In fact, this charging device is tolerant as regards both the point of impact and the shape of the flow fed to the rotary distributor, since they influence the path of the flow on the rotary distributor only insignificantly. By virtue of its continuous inclined sliding surface, the junction slide allows to direct charge material to one specific guiding member, and subsequently to one specific charging ring, solely through variation of the rotating velocity.

Preferably, each guiding member has a different configuration, corresponding to a charging ring of given radius on a charging surface of the shaft furnace. The length and/or inclination of each guiding member is advantageously arranged such that each guiding member leads charge material to a different annular area, i.e. charging ring, on the charging surface.

In a preferred embodiment, the guiding members issue from a downstream perimeter of the junction slide over an angular sector of at most 180°. Herein, it is beneficial to arrange the guiding members consecutively in adjacent angular intervals of this angular sector. Furthermore, the junction slide is preferably inclined at an angle in the range between 35° and 65° with respect to the axis of rotation of the rotary distributor.

A rotatable suspension structure comprising two lateral mounting flanges for supporting the rotary distributor and a central passage for feeding charge material onto the rotary distributor, represents a support for the rotary distributor which is of simple and reliable construction.

For charging the central area of the charging surface, i.e. the area about the central axis of the furnace, at least one of the guiding members preferably comprises an elbow shaped deflector section.

In one embodiment, the rotary distributor further comprises an inclined admission portion for receiving a flow of charge material, the admission portion crossing the axis of rotation and leading into the junction slide. Consequently, the rotary distributor is mounted in eccentric manner and its shape is rotationally asymmetrical.

In order to increase tolerance and charging versatility, each guiding member advantageously has an upstream entrance cross-section significantly exceeding the corresponding cross-section of a charge material flow.

As is apparent, the charging device according to the invention is particularly suitable for installation in a blast furnace.

BRIEF DESCRIPTION OF THE FIGURES

The present invention will be more apparent from the following description of a not limiting embodiment with reference to the attached drawings. In these drawings, wherein identical reference numerals are used to indicate identical or similar elements.

DETAILED DESCRIPTION OF THE INVENTION

Figure 1:
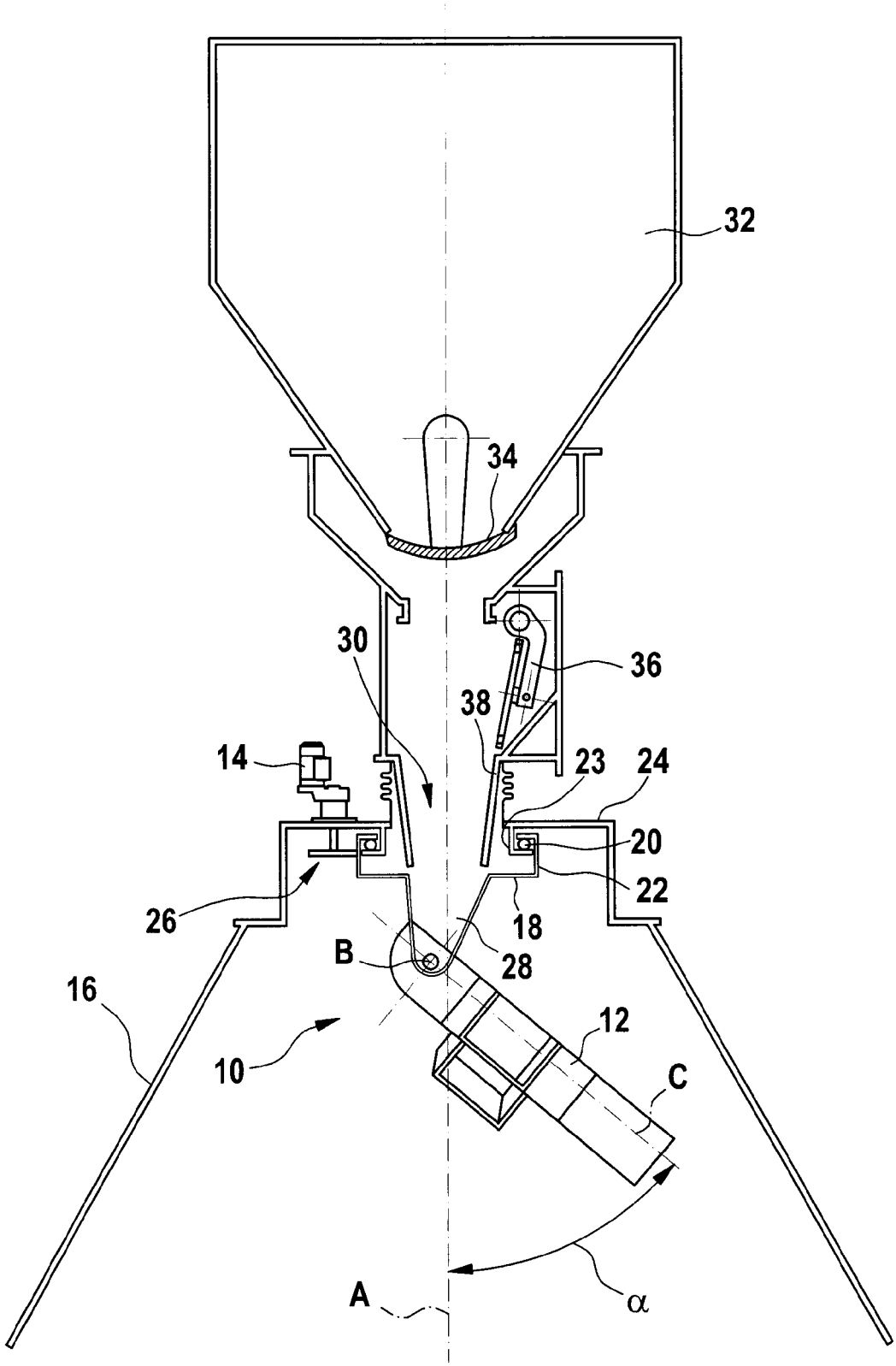
FIG. 1: is a partial vertical cross-sectional view of a blast furnace comprising a charging device according to the invention.

In FIG. 1 a charging device for charging and distributing bulk material onto a charging surface is generally identified by reference numeral 10. The charging device 10 comprises a rotary distributor 12 and a variable drive 14, e.g. an electric servo-motor. The rotary distributor 12 is suspended in the throat region of a blast furnace 16 by a suspension structure 18. An antifriction bearing 20 rotatably connects an upper ring flange 22 of the suspension structure 18 to a supporting ring flange 23 fixed to a top closure 24 of the blast furnace 16. The bearing 20 and the ring flanges 22, 23 are arranged such that the rotary distributor 12 is rotatable about the central axis A of the blast furnace 16. The variable drive 14 is fixed on the top closure 24 and connected to the suspension structure 18 by means of a gear mechanism 26 for communicating this rotation to the rotary distributor 12. The gear mechanism 26 comprises for example a gearwheel connected to the axle of the variable drive 14 and engaging an outer toothed ring fixed to the upper ring flange 22 as shown in FIG. 1. Other drive mechanisms are however not excluded. The suspension structure 18 further comprises two lateral mounting flanges 28 which support the upper end portion of the rotary distributor 12 on an essentially horizontal axis B. The suspension structure 18 provides a central passage 30 through which charge material can fall vertically onto the upper end portion of rotary distributor 12.

As further seen in FIG. 1 a hopper 32 for intermediate storage of charge material is installed above the top closure 24. A flow control gate valve 34 is arranged at the outlet of the hopper 32 to enable precise metering of charge material. A lower sealing valve 36 ensures gas tight sealing of the furnace throat, when the hopper 32 is not being discharged, whereas an upper sealing valve (not shown) ensures sealing during charging. Downstream of hopper 32, a funnel segment 38 constricts and centres the flow of charge material.

Figure 2:
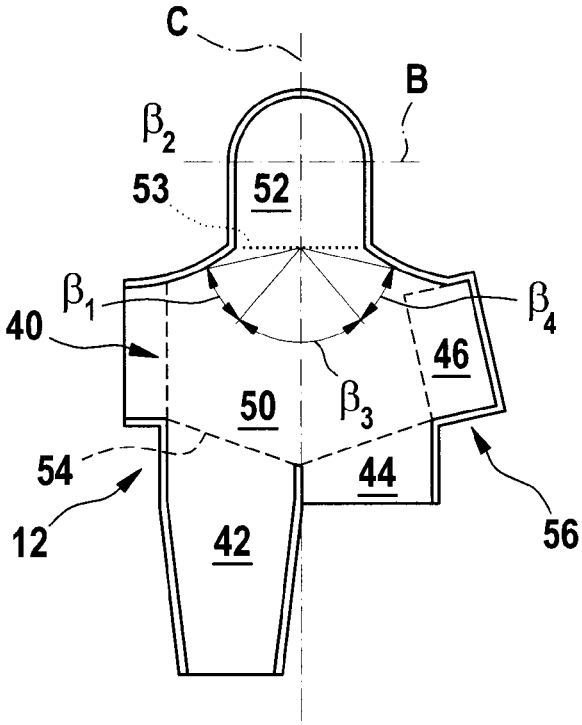
FIG. 2: is a plan view of a rotary distributor used in the charging device of FIG. 1.

FIG. 2 shows the rotary distributor 12 in plan view. It comprises a plurality of guiding members and more precisely: a first guiding member 40, a second guiding member 42, a third guiding member 44 and a fourth guiding member 46. The number of guiding members actually chosen depends on installation specific requirements, such as the blast furnace diameter and the desired number of separate charging rings. As seen in FIG. 2, the rotary distributor 12 further comprises a junction slide 50, from which the guiding members 40, 42, 44, 46 issue. In operation, the junction slide 50 provides an inclined, preferably smooth, uninterrupted surface down which a flow of charge material can slide. An admission portion 52 for receiving charge material is joined to an upstream perimeter portion 53 of the junction slide 50, shown by a dotted line. In the blast furnace 16, the admission portion 52 crosses axis A as seen in FIG. 1. The admission portion 52 leads into the junction slide 50 from which originate the downstream guiding members 40, 42, 44, 46.

As indicated by dashed lines in FIG. 2, the guiding members 40, 42, 44, 46 issue from a downstream perimeter portion 54 of the junction slide 50. The perimeter portion 54 covers an angular sector of approximately 150°, a value of at most 180° being preferred. As shown by angle $\beta_1$ to $\beta_4$ in FIG. 2, the guiding members 40, 42, 44, 46, and more precisely their respective entrances, are arranged in consecutive adjacent, preferably equal, angular intervals of this angular sector. Hence, the junction slide 50 further provides the surface through which the guiding members 40, 42, 44, 46 are joined and communicate with the admission portion 52.

As seen in FIG. 1, the rotary distributor 12 and in particular the junction slide 50 is inclined with respect to axis A by a fixed angle $\alpha$. The angle $\alpha$ is the angle comprised between a longitudinal axis C of the rotary distributor 12 and the axis of rotation A. The angle $\alpha$ is preferably chosen in the range of 35° to 65°. When compared to the applicant's BLT system, this angle is not varied during charging but may be adjusted at rest, e.g. during maintenance. The inclination angle $\alpha$ is chosen so as to maintain a certain radial velocity of From FIG. 1 and FIG. 2 also follows that the bottom line of the admission portion 52 and the bottom surfaces of the first to third guiding members 40, 42, 44 have the same inclination by angle $\alpha$, since they are coplanar with the surface of junction slide 50. The fourth guiding member 46 however comprises an elbow shaped deflector section 56 for charging the central area of the blast furnace 16.

Figure 3:
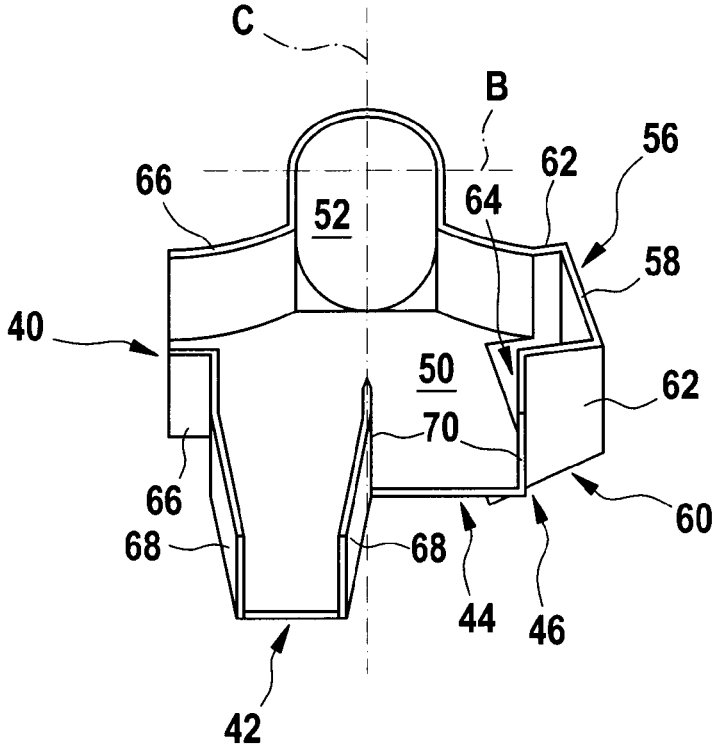
FIG. 3: is a three-dimensional view of the rotary distributor of FIG. 2.

As best seen in FIG. 3, the elbow shaped deflector section 56 comprises a transverse deflector plate 58, a lower deflector plate 60 and lateral side walls 62 as well as an opening 64 defined by the latter and an edge of the junction slide 50. FIG. 3, further shows that the admission portion 52 has a concave shape of half a hemisphere joined to a semi-cylindrical portion when viewed downstream, in order to insure proper collection of the charge material. FIG. 3 further shows lateral side walls 66 of the first guiding member 40, lateral side walls 68 of the second guiding member 42 and lateral side walls 70 of the third guiding member 70 (partially coinciding with side wall 68). As will be appreciated, longer guiding members such as the second guiding member 42 are provided with side walls 68 arranged so as to constrict the flow of charge material towards the outlet of this guiding member. Thereby, undesired spreading of the charge material stream is avoided.

By means of FIG. 4 to FIG. 7, the principle of operation of the charging device 10 comprising the rotary distributor 12 will become more apparent.

During the charging process, charge material is fed from hopper 32 onto the rotary distributor 12 in form of a flow or stream falling vertically onto the admission portion 52. As will be apparent from what is described below, it is not necessary for the flow of charge material to be strictly coaxial to axis A neither to be strictly rotationally symmetrical. The inclination by angle $\alpha$ of the rotary distributor 12, and in particular of the admission portion 52 and of the junction slide 50, imparts a radial component to the velocity of the flow of charge material. As a result, immediately after leaving the admission portion 52, the direction of the velocity of the flow is approximately that of axis C.

Rotation of the rotary distributor 12 by means of the variable drive 14 insures circumferential distribution of charge material in the form of uniform charging rings on the charging surface. Furthermore, according to the invention, this rotation imparts an angular component to the velocity of the flow of charge material, whereby its direction is deviated from that of axis C during rotation (with the rotary distributor 12 as reference frame). Due to the shape of the junction slide 50, charge material slides via one specific guiding member 40, 42, 44 or 46 in function of the velocity and/or the sense of rotation of the rotary distributor 12 as pointed out by FIG. 4 to FIG. 7.

In FIG. 4 to FIG. 7 four simulated charge material flow paths are depicted, which correspond respectively to four different rotating velocities $\omega_1$ to $\omega_4$ of the rotary distributor 12. In a specific example of a blast furnace 16 with a throat diameter of 6 m and a length of the rotary distributor 12 of 2.4 m (measured along C from the intersection of B and C to the end of guiding member 42), suitable rotating velocities are e.g. $\omega_1$=−17 rpm; $\omega_2$=−7.5 rpm; $\omega_3$=7.5 rpm; $\omega_4$=17 rpm, with rpm standing for revolution/min and negative values indicating anticlockwise rotation. These different flow paths result to a large extent from the effect of the Coriolis pseudo-force, which depends on the rotating velocity of the rotary distributor 12, and to a lesser extent from frictional and centrifugal forces. The different rotating velocities can be determined empirically or, as is the case in the example above, by calculation taking into account the determining parameters, such as geometry of the rotary distributor 12, impact velocity of the flow, type and composition of the charge material, etc.

By virtue of a respective individual and different configuration of each guiding member 40, 42, 44 or 46, the flow of charge material exits the rotary distributor 12 at a different position and with different velocity vector (i.e. at a different coordinate and with a different velocity vector as regards radius, polar angle and azimuth angle in a spherical coordinate system defined by axis A and the origin being the point of intersection of axis A with the admission portion 52). This is achieved by varying the individual length and/or the individual inclination of each guiding member 40, 42, 44 or 46. As will be appreciated, each guiding member 40, 42, 44 or 46, in combination with an appropriate rotating velocity $\omega_1$ to $\omega_4$, leads charge material to a different annular area of the charging surface, i.e. a different charging ring. Herein the charging ring with smallest radius (measured from axis A), i.e. the central region of the charging surface is charged through the fourth guiding member 46. The second smallest ring is obtained via the first guiding member 40, whereas the second and third guiding member 42, 44 respectively serve to charge the largest and second largest diameter. In the aforementioned specific example, the radii have been calculated to be $r_1$=1.5 m for guiding member 40 ($\omega_1$), $r_2$=2.8 m for guiding member 42 ($\omega_2$), $r_3$=2.3 m for guiding member 44 ($\omega_3$) and $r_4$=0.5 m for guiding member 46 ($\omega_4$) respectively. It may be noted that all indicated values are installation specific and given merely for the purpose of illustration.

Figure 4:
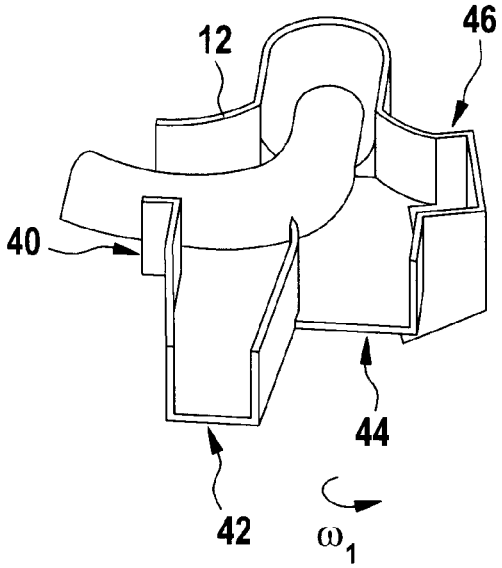
FIG. 4: is a three-dimensional view schematically illustrating a first sliding path of charge material on the rotary distributor of FIG. 3 when rotated in a first direction with a first velocity.
Figure 5:
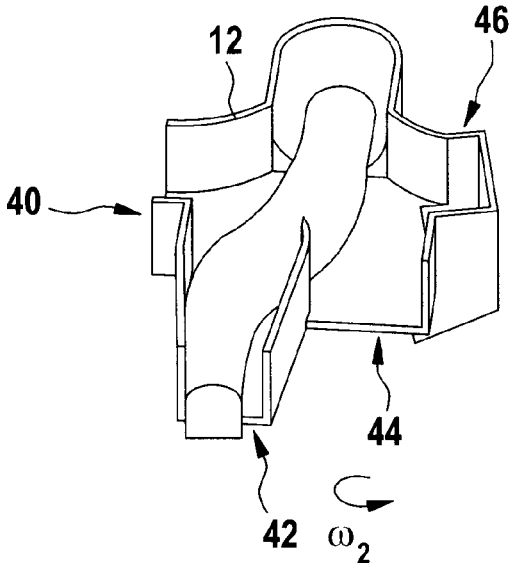
FIG. 5: is a three-dimensional view schematically illustrating a second sliding path of charge material on the rotary distributor of FIG. 3 when rotated in the first direction with a second velocity.
Figure 6:
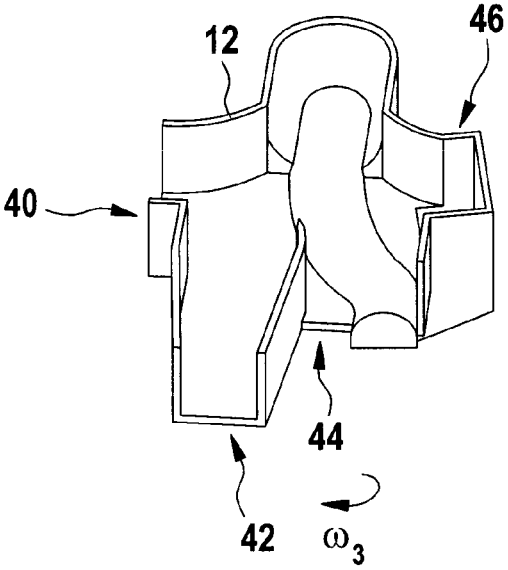
FIG. 6: is a three-dimensional view schematically illustrating a third sliding path of charge material on the rotary distributor of FIG. 3 when rotated in a second direction with a third velocity.
Figure 7:
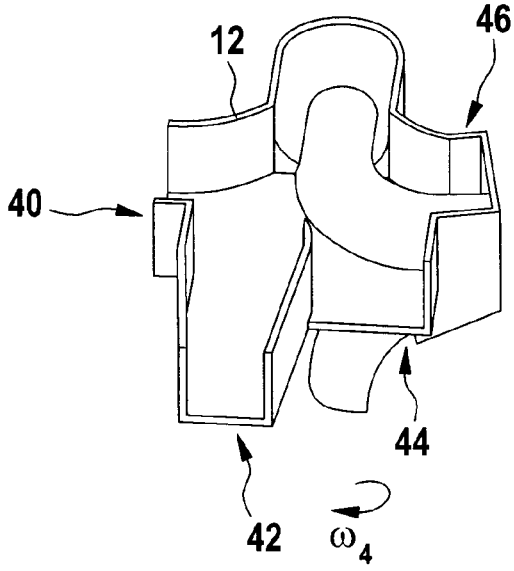
FIG. 7: is a three-dimensional view schematically illustrating a fourth sliding path of charge material on the rotary distributor of FIG. 3 when rotated in the second direction with a fourth velocity.

As further seen in FIG. 4, the entrance cross-section of each guiding member 40, 42, 44, 46 is significantly larger than the cross-section of the flow of charge material at this point. As a result, the velocities $\omega_1$ to $\omega_4$ can be increased or lowered within a certain range by a small amount $\delta_w$ while still maintaining a path through the respective guiding member 40, 42, 44 or 46. This increases the system tolerance. By virtue of the accompanying variation in centrifugal force, this allows to achieve a finer resolution as regards the radii of charging rings, i.e. $r_i$+/−$\delta_r$. In fact, the radial velocity component of the flow of charge material is generally non zero when it exits the rotary distributor 12, due to the inclination of the latter and inertia. A certain minimal radial velocity component is insured by virtue the inclination angle $\alpha$, whereby friction is reduced, a continuous flow is maintained and congestion of the flow is avoided. Although, as opposed to the device disclosed in U.S. Pat. No. 5,695,085, the working principle of the rotary distributor 12 differs from that of a relatively imprecise centrifugal spreader, such small variations, i.e. $\omega_i$+/−$\delta_\omega$, can be used to modify this non-zero radial velocity component to some extent.

Furthermore it will be appreciated, that charge material is charged in form of a single, coherent flow or stream, whereby improved circumferential uniformity of the charging profile is insured and requirements imposed on the feeding of material onto the rotary distributor 12 are reduced, in contrast to comparable prior art devices. Finally, it may be noted that the described compact construction of the rotary distributor 12 requires little volume which allows for easy removal and installation of the latter through a corresponding maintenance door in the top closure 24, e.g. for refurbishment and/or replacement.

What is claimed is:

1. A charging device for charging a shaft furnace, comprising a rotary distributor comprising a plurality of sliding channels joined by a junction slide from which each of said plurality of sliding channels extends;

a variable drive for rotating said plurality of sliding channels about an essentially vertical axis of rotation with an adjustable velocity, wherein said junction slide is arranged and shaped such that said sliding channels are individually selectable for a flow of charge material based on at least one of the adjustable velocity and rotational direction of said rotary distributor, as actuated by said variable drive, wherein the length and/or inclination of at least two of said plurality of sliding channels are arranged to lead charge material to a different annular area of a charging surface, wherein outputs of a totality of said plurality of sliding channels extending from said rotary distributor are positioned to extend into an area covering at most 180° of an angular sector taken about an essentially vertical axis of rotation of said plurality of sliding channels, and wherein said plurality of sliding channels includes three or more sliding channels.

2. The charging device according to claim 1, wherein said junction slide is inclined at an angle in the range between 35° and 65° with respect to the axis of rotation of said rotary distributor.

3. The charging device according to claim 1, wherein said junction slide is inclined at an angle in the range between 35° and 65° with respect to the axis of rotation of said rotary distributor.

4. The charging device according to claim 3, further comprising a rotatable suspension structure comprising two lateral mounting flanges for supporting said rotary distributor and a central passage for feeding charge material onto said rotary distributor.

5. The charging device according to claim 1, further comprising a rotatable suspension structure comprising two lateral mounting flanges for supporting said rotary distributor and a central passage for feeding charge material onto said rotary distributor.

6. The charging device according to claim 1, wherein at least one of said sliding channels comprises an elbow shaped deflector section for charging the central area of a charging surface.

7. The charging device according to claim 1, wherein said rotary distributor further comprises an inclined admission portion for receiving a flow of charge material, said admission portion crossing said axis of rotation and leading into said junction slide.

8. The charging device according to claim 1, wherein the shape of said rotary distributor is rotationally asymmetrical.

9. The charging device according to claim 1, wherein each sliding channel has an upstream entrance cross-section significantly exceeding the corresponding cross-section of a charge material flow.

10. A charging device for charging a shaft furnace, comprising a rotary distributor, said distributor comprising:

a plurality sliding channels having a length and/or inclination configured to lead charge material to a different annular area of a charging surface;

an admission portion for receiving charge material; and a junction slide having a downstream perimeter from which each sliding channel extends and an upstream perimeter to which said admission portion is joined, said junction slide providing a surface through which each of said sliding channels communicates with said admission portion;

a variable drive for rotating said plurality of sliding channels about an essentially vertical axis of rotation with an adjustable velocity, wherein said device is arranged such that said sliding channels are individually selectable for a flow of charge material based on at least one of the adjustable velocity and a rotation of said rotary distributor, as actuated by said variable drive, wherein outputs of a totality of said plurality of sliding channels extending from said rotary distributor are positioned to extend into an area covering at most 180° of an angular sector taken about an essentially vertical axis of rotation of said plurality of sliding channels, wherein said plurality of sliding channels includes three or more sliding channels.

11. The charging device according to claim 10, further comprising a rotatable suspension structure comprising two lateral mounting flanges supporting said rotary distributor and a central passage for feeding charge material onto said rotary distributor, wherein said junction slide is inclined at an angle in the range between 35° and 65° with respect to the axis of rotation of said rotary distributor.

12. The charging device according to claim 10, wherein at least one of said sliding channels comprises an elbow shaped deflector section for charging the central area of a charging surface, said elbow shaped deflector section comprising a transverse deflector plate, a lower deflector plate and lateral side walls and an opening defined by said side walls and said junction slide.

13. The charging device according to claim 10, wherein said admission portion for receiving a flow of charge material to be lead to said junction slide is inclined and crosses said axis of rotation.

14. The charging device according to claim 10, wherein each guiding member has an upstream entrance cross-section significantly exceeding the corresponding cross-section of a charge material flow.

15. A blast furnace comprising a charging device, said charging device comprising:

a rotary distributor comprising a plurality of sliding channels joined by a junction slide having a downstream perimeter portion from which each guiding member originates;

a variable drive for rotating said rotary distributor about an essentially vertical axis of rotation, with an adjustable velocity, wherein said charging device is arranged such that said sliding channels are individually selectable for a flow of charge material slides based on at least one of the adjustable velocity and a rotation of said rotary distributor, as actuated by said variable drive, wherein at least one of said sliding channels comprises an elbow shaped deflector section for charging the central area of a charging surface, said elbow shaped deflector section comprising a transverse deflector plate, a lower deflector plate and lateral side walls and an opening defined by said side walls and said junction slide.

16. The blast furnace according to claim 15, wherein said junction slide is inclined at an angle in the range between 35° and 65° with respect to the axis of rotation of said rotary distributor.

17. The blast furnace according to claim 16, wherein at least one of said guiding members comprises an elbow shaped deflector section for charging the central area of a charging surface.

18. The blast furnace device according to claim 15, wherein each sliding channel has an upstream entrance cross-section significantly exceeding the corresponding cross-section of a charge material flow.

19. A charging device for charging a shaft furnace, comprising a rotary distributor comprising a plurality of sliding channels joined by a junction slide from which each of said plurality of sliding channels extends;

a variable drive for rotating said rotary distributor about an essentially vertical axis of rotation with an adjustable velocity, wherein said junction slide is arranged and shaped such that said sliding channels are individually selectable for a flow of charge material based on at least one of the adjustable velocity and rotational direction of said rotary distributor, as actuated by said variable drive, wherein said junction slide is inclined at an angle in the range between 35° and 65° with respect to the axis of rotation of said rotary distributor.

* * * * *